US007537126B2

(12) United States Patent
Kurotsu et al.

(10) Patent No.: US 7,537,126 B2
(45) Date of Patent: May 26, 2009

(54) CRANE

(75) Inventors: Hitoshi Kurotsu, Akashi (JP); Kazumi Higashitani, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 11/939,965

(22) Filed: Nov. 14, 2007

(65) Prior Publication Data

US 2008/0116161 A1 May 22, 2008

(30) Foreign Application Priority Data

Nov. 20, 2006 (JP) ..... 2006-313446

(51) Int. Cl.
*B66C 23/82* (2006.01)

(52) U.S. Cl. ..... 212/300; 212/239; 212/262

(58) Field of Classification Search ..... 212/239, 212/262, 300

See application file for complete search history.

(56) References Cited

U.S. PATENT DOCUMENTS 3,572,517 A * 3/1971 Liebherr et al. ..... 212/300
6,568,547 B1 * 5/2003 Kretschmer et al. ..... 212/196
2002/0027118 A1 * 3/2002 Willim ..... 212/302

FOREIGN PATENT DOCUMENTS

JP 2001-39678 2/2001

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A crane includes a boom and boom pivoting mast connected to a swivel body so as to be pivotable, a boom pivoting winch for pivoting the boom, and a main hoisting winch and auxiliary hoisting winch for hoisting up and hoisting down a hanging load. The main and auxiliary hoisting winches are mounted on the boom, while the boom pivoting winch is mounted on the boom pivoting mast.

10 Claims, 7 Drawing Sheets

CRANE

BACKGROUND OF THE INVENTION

1. Field of the Invention

The present invention relates to a crane having tilt members including a boom and being provided with a variety of winches.

2. Description of the Related Art

There is a type of crane that is equipped with a main hoisting winch and an auxiliary hoisting winch for hoisting up and hoisting down a hanging load, respectively, which is hung from an end portion of a topmost one of tilt members including a boom. A crane disclosed in, for example, Japanese Unexamined Patent Application Publication No. 2001-39678 is equipped with a boom pivoting winch for pivoting a boom connected to its front edge portion of the swivel body, a main hoisting winch and an auxiliary hoisting winch on the swivel body. The boom pivoting winch allows the boom to pivot by reeling in or reeling out a boom pivoting rope. A main hoisting rope and an auxiliary hoisting rope drawn from the main hoisting winch and the auxiliary hoisting winch are hung from a top portion of the boom, respectively, and are each provided with a hook for suspending a load in the end of the rope.

In the case when such a relatively large crane as disclosed in the patent document is transported, the crane is, in most cases, disassembled to reduce transportation costs. Specifically, crane components such as a boom and the like (for example, a mast and a gantry) are removed from the swivel body corresponding to a crane body, and the swivel body is transported as a single unit after disassembling.

At that time, however, a boom pivoting winch and both main and auxiliary hoisting winches are still mounted on the swivel body; the transportation costs of the swivel body become higher by a portion of the weight of the winches.

SUMMARY OF THE INVENTION

Accordingly, it is an object of the present invention to provide a crane that enables its crane body to be light in weight after disassembled, although being equipped with a variety of winches.

A crane according to the present invention includes a crane body, tilt members, including a boom connected to the crane body so as to be pivotable, that pivot as a whole as the boom pivots, and a main hoisting rope and an auxiliary hoisting rope for each hoisting a hanging load, the main and auxiliary hoisting ropes being each hung from a top end portion of the tilt members. Furthermore, this crane includes a main hoisting winch for hoisting up and hoisting down the main hoisting rope, an auxiliary hoisting winch for hoisting up and hoisting down the auxiliary hoisting rope, a boom pivoting member connected to the crane body, the boom pivoting member being also connected to the boom at a specified portion thereof spaced apart from the crane body to the boom, a boom pivoting rope strung in an area between the boom pivoting member and the crane body or between the boom pivoting member and the boom, and a boom pivoting winch for reeling in and reeling out the boom pivoting rope to pivot the tilt members; wherein both the main and auxiliary hoisting winches are mounted on the boom, and the boom pivoting winch is mounted on the boom pivoting member.

In this case, the main and auxiliary hoisting winches hoisting up and hoisting down the main and auxiliary hoisting ropes, respectively, and the boom pivoting winch reels in and reels out the boom pivoting rope, by which the tilt members including the boom pivot as a whole in a tilting direction.

The main and auxiliary hoisting winches are both mounted on the boom, and the boom pivoting winch is mounted on the boom pivoting member. Accordingly, when the crane is disassembled (i.e., disassembling work for removing the boom and the boom pivoting members), the winches do not remain on the crane body after the disassembling work is completed, which leads effectively to a reduction of transportation costs for the crane body.

The boom can be composed of a single member, but is desirably composed of a base-end-side member connected to the crane body so as to be pivotable, at least one of intermediate members connected to the top end of the base-end-side member so as to be detachable, and a top-end-side member connected to the top end of the topmost one of the intermediate members so as to be detachable, and provided with sheaves for guiding the main and auxiliary hoisting ropes, respectively, on the top-end-side member or on another tilt member above the top-end-side member, and also with the main and auxiliary hoisting winches on the base-end-side member.

The boom can be disassembled, and the disassembling of the boom contributes to reduce the cost for transporting the boom. Additionally, installation of the main and auxiliary hoisting winches on the base-end-side member brings about the following advantages.

(i) Since the base-end-side member is located the most far from the top end of the boom, the installation of the main and auxiliary hoisting winches on the base-end-side member allows each of the fleet angles (the maximum value of angles (so-called a deviation angle) between each of the ropes from the respective sheaves located most close to the winches and a plane that passes through each of the sheaves and crosses the winch drum of each of the winches vertically) to be made small. The reduction in the fleet angles is conducive to prevention of wear and damage of each of the ropes.

(ii) Since the base-end-side member is connected to the crane body, there would be little risk to assemble it in wrong order, not as with the intermediate member. Accordingly, the installation of the above winches on this base-end-side member ensures that they are disposed at predetermined positions in the crane.

(iii) Since the base-end-side member is positioned in the location most close to the crane body, the installation of the main and auxiliary hoisting winches on the base-end-side member brings about another advantage that the length of power transmission members (for example, hydraulic piping and electric wiring) connecting the winches to the power source mounted on the crane body becomes short. Furthermore, disconnection of the power transmission members (for example, disassembly of the hydraulic piping or disconnection of connectors used for the electric wiring) becomes unnecessary.

In addition to the above, the base-end-side member is desirably structured to have a back surface on the tilt-up side of the tilt members and an abdominal surface on the tilt-down side of the tilt members, and further to have a shape such that the distances between the back and abdominal surfaces become smaller with increasing proximity to the crane body, and the main and auxiliary hoisting winches are mounted on the back surface.

In this case, the installation of the winches on the portion where the distance between the back and abdominal surfaces is smaller than other portions enables the outside shape of the whole boom including the winches to be compact.

In the present invention, the tilt members can be composed of only the boom, but they desirably include adding to the boom a jib connected to a top end portion of the boom so as to be pivotable in a direction with respect to the boom, a jib pivoting rope for pivoting the jib and a jib pivoting winch for pivoting the jib by reeling in and reeling out the jib pivoting rope. Because the jib juts toward the tilt-down direction of the boom, the working area covered by the whole tilt members can be enlarged. Moreover, although the jib pivoting winch is mounted on the boom, the light-weight effect of the crane body after completion of disassembling work can be kept, since the jib pivoting winch does not remain on the crane body after the crane is disassembled.

In this case, the crane is desirably provided with first and second jib pivoting members each connected to a top end portion of the boom so as to jut out in a direction toward which the boom is tilted up; wherein the jib pivoting rope drawn from the jib pivoting winch via the first jib pivoting member is strung between the second jib pivoting member and the jib, the jib pivoting winch being mounted on the boom at a position closer to the crane body than the main and auxiliary hoisting winches. Due to this disposition, the jib pivoting rope drawn from the jib pivoting winch and the main and auxiliary hoisting ropes drawn from the main and auxiliary hoisting winches respectively can be strung without being interfered with each other, although the jib pivoting winch is mounted together with the main and auxiliary hoisting winches on the same boom member.

Furthermore, the boom is desirably provided with a guide sheave for guiding the jib pivoting rope, the guide sheave being placed between the jib pivoting winch and the main and the auxiliary hoisting winches at some distance from the boom surface so that the jib pivoting rope drawn from the jib pivoting winch is not interfered with by the respective main and auxiliary hoisting winches.

Due to this arrangement, the jib pivoting rope drawn from the jib pivoting winch can be prevented from coming into contact with the main and the auxiliary hoisting winches, even though the jib pivoting winch is positioned near to the main and the auxiliary hoisting winches.

In the present invention, the specific configuration of the boom pivoting member is not restricted to the above embodiment. The boom pivoting member may include, for example, a mast connected to the crane body so as to be pivotable in a direction toward which the boom pivots, the boom being connected to the mast so as to pivot in synchronization therewith, and the boom pivoting rope may be strung between the mast and the crane body so that the mast is pivoted by the boom pivoting rope reeled in and reeled out by the boom pivoting winch, or the boom pivoting member may include a rope supporting member connected to the crane body so as to be held in a specified position, and the boom pivoting rope is strung between the rope supporting member and the crane body so that the boom is pivoted as the boom pivoting rope is reeled in or reeled out by the boom pivoting winch.

In the latter case, the rope supporting member can be a member fixed to a crane body such as an ordinary gantry, but may be a mast connected to the crane body so as to be pivotable in the same direction as the pivoting direction of the boom. In this case, there are desirably provided with a backstop for supporting the mast from the back side thereof at a predetermined angle and mast pivoting means for pivoting the mast so as to allow the mast to be pushed to the backstop and to hold the mast at the angled position. Then, if the mast pivoting means are connected to the crane body so as to be pivotable in the same direction as the pivoting direction of the mast, and have an auxiliary mast connected to the mast so that the specified pivoting portion pivots in synchronization with the mast and a mast pivoting winch for pivoting the auxiliary mast, the mast pivoting winch being is mounted on the auxiliary mast, the mast pivoting winch can be removed from the crane body together with the auxiliary mast when the crane is disassembled. This allows the light-weight effect of the crane body after completion of disassembling work of the crane to be maintained although the mast pivoting winch is additionally provided.

As described above, the crane according to the present invention, although being equipped with the boom pivoting winch and the main and auxiliary hoisting winches, allows the crane body to be light in weight, and enables the disassembling work to be efficiently carried out.

DESCRIPTION OF THE PREFERRED EMBODIMENTS

A first embodiment of the present invention will now be described with reference to FIGS. 1 to 6.

Figure 1:
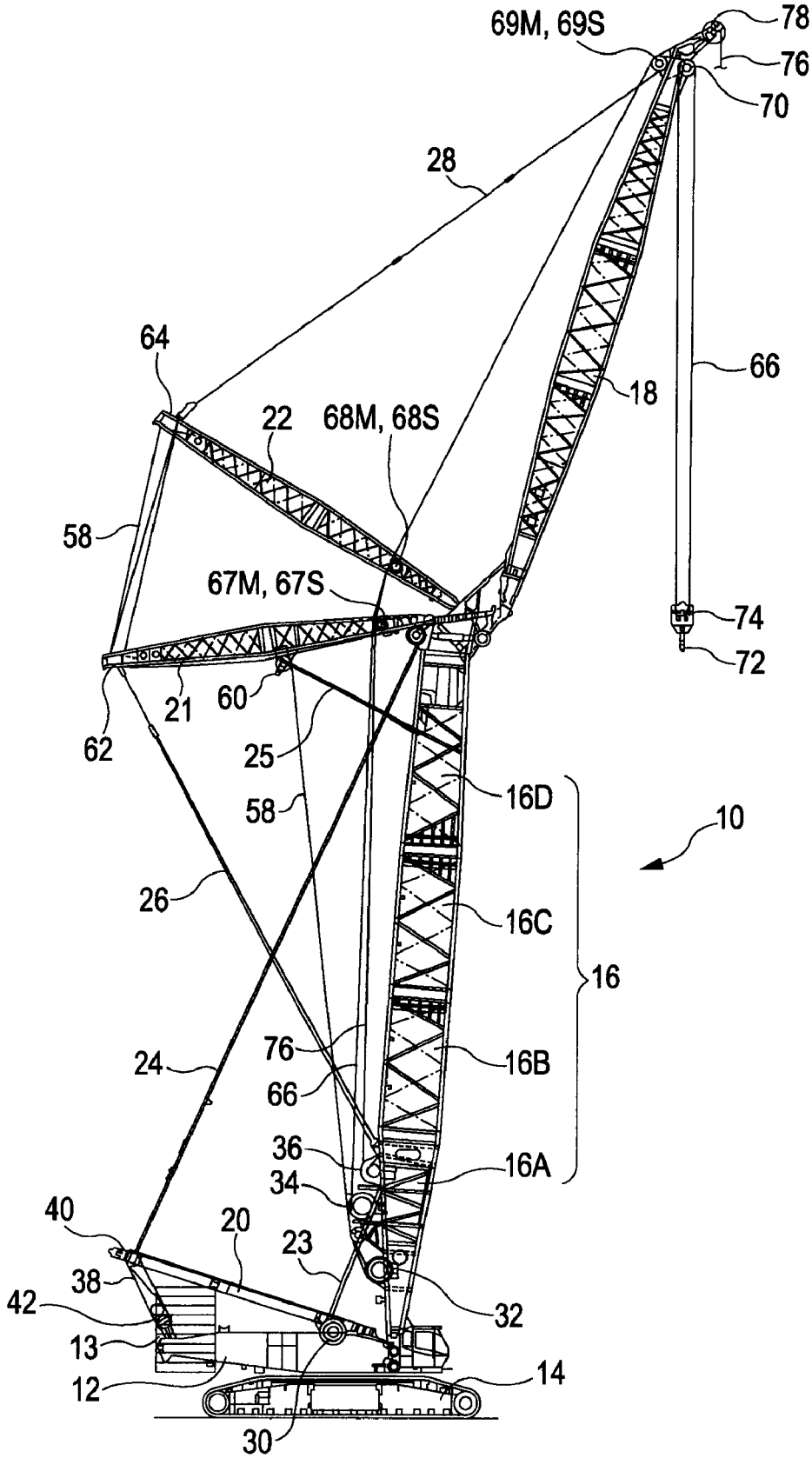
FIG. 1 is an overall side view of a crane according to a first embodiment of the present invention.

FIG. 1 shows a general structure of a crane 10 according to this embodiment. The crane 10 consists of a swivel body 12, which constitutes a crane body of this crane, a travel body 14 for supporting the swivel body 12 so as to be swivelable, tilt members including a boom 16 and a jib 18, and a mast 20, which is a member for pivoting the boom.

The boom 16 shown in the attached figures is of a so called lattice type, and is composed of a base-end-side member 16A, one or a plurality of (two in the exemplary figures) intermediate members 16B and 16C, and a top-end-side member 16D. More specifically, the base-end-side member 16A is connected to a front portion of the swivel body 12 so as to be pivotable in the tilting direction of the boom. The intermediate members 16B and 16C are connected to the top end of the base-end-side member 16A, in this order, so as to be detachable. The top-end-side member 16D is further connected to the top end of the intermediate member 16C so as to be detachable, and to the top end of the top-end-side member 16D, as described later, a rear strut 21 (first jib pivoting member) and a front strut 22 (second jib pivoting member) for pivoting the jib 18 are connected so as to be pivotable.

The jib 18 is also of a lattice type, and the base end portion thereof is connected to the top end portion of the top-end-side member 16D so as to be pivotable in the tilting direction of the jib.

The mast 20 has a base end and pivot end, the base end being connected to the swivel body 12 so as to be pivotable.

The pivot axis of the mast 20 is parallel to the pivot axis of the boom 16 and is situated just behind the axis of the boom 16. That is, the mast 20 is pivotable in the same direction as the tilting direction of the boom 16. On the other hand, the pivot end of the mast 20 is connected to the top end of the boom 16 through a left and right pair of boom guylines 24; the boom 16 thereby pivots in synchronization with the mast 20.

On the swivel body 12, a left and right pair of backstops 23 is provided. The backstops 23 come into contact with left and right side portions of the base-end-side member 16A when the boom 16 reaches to the standing position shown in FIG. 1; whereby, the boom 16 is prevented from being excessively pivoted.

The rear strut 21 is held in such a position as to jut out from the top end of the top-end-side member 16D toward the direction in which the boom 16 is tilted up (to the left side in FIG. 1). As a means for holding the position of the rear strut 21, a left and right pair of backstops 25 and a left and right pair of guylines 26 are used between the rear strut 21 and boom 16. The backstops 25 are used between the top-end-side member 16D and an intermediate portion of the rear strut 21, and support the rear strut from below. The guylines 26 are provided to be stretched between the top end of the rear strut and the base-end-side member; the position of the rear strut 21 is restricted by the tension of the guylines 26.

The front strut 22 is connected to the jib 18 so as to pivot in synchronization therewith. More specifically, a left and right pair of guylines 28 is provided to be stretched between the top end of the front strut 22 and the top end of the jib 18. Therefore, the jib 18 is pivoted in synchronization with this front strut 22.

The crane 10 is equipped with various winches, i.e., specifically, a boom pivoting winch 30 for pivoting the boom 16, a jib pivoting winch 32 for pivoting the jib 18 in a tilting direction, and a main hoisting winch 34 and an auxiliary hoisting winch 36 for hoisting up or hoisting down a hanging load. A feature of this crane 10 is that the boom pivoting winch 30 is mounted on a portion close to the base end of the mast 20, while the jib pivoting winch 32, main hoisting winch 34 and auxiliary hoisting winch 36 are all mounted on the base-end-side member 16A of the boom 16.

The boom pivoting winch 30 reels in and reels out a boom pivoting rope 38, whereby the boom pivoting rope 38 is strung so as to allow the mast 20 to pivot. More specifically, there are provided sheave blocks 40 and 42, each of which is composed of a plurality of sheaves disposed in a width direction, on the pivot end portion of the mast 20 and the rear end portion of the swivel body 12, respectively, and the boom pivoting rope 38 drawn from the boom pivoting winch 30 is looped over the sheave blocks 40 and 42. Accordingly, the boom pivoting winch 30 changes the distance between the sheave blocks 40 and 42 by reeling in or reeling out the boom pivoting rope 38, and thereby pivots the mast 20 and the boom 16 synchronized therewith in the tilting direction.

Figure 2:
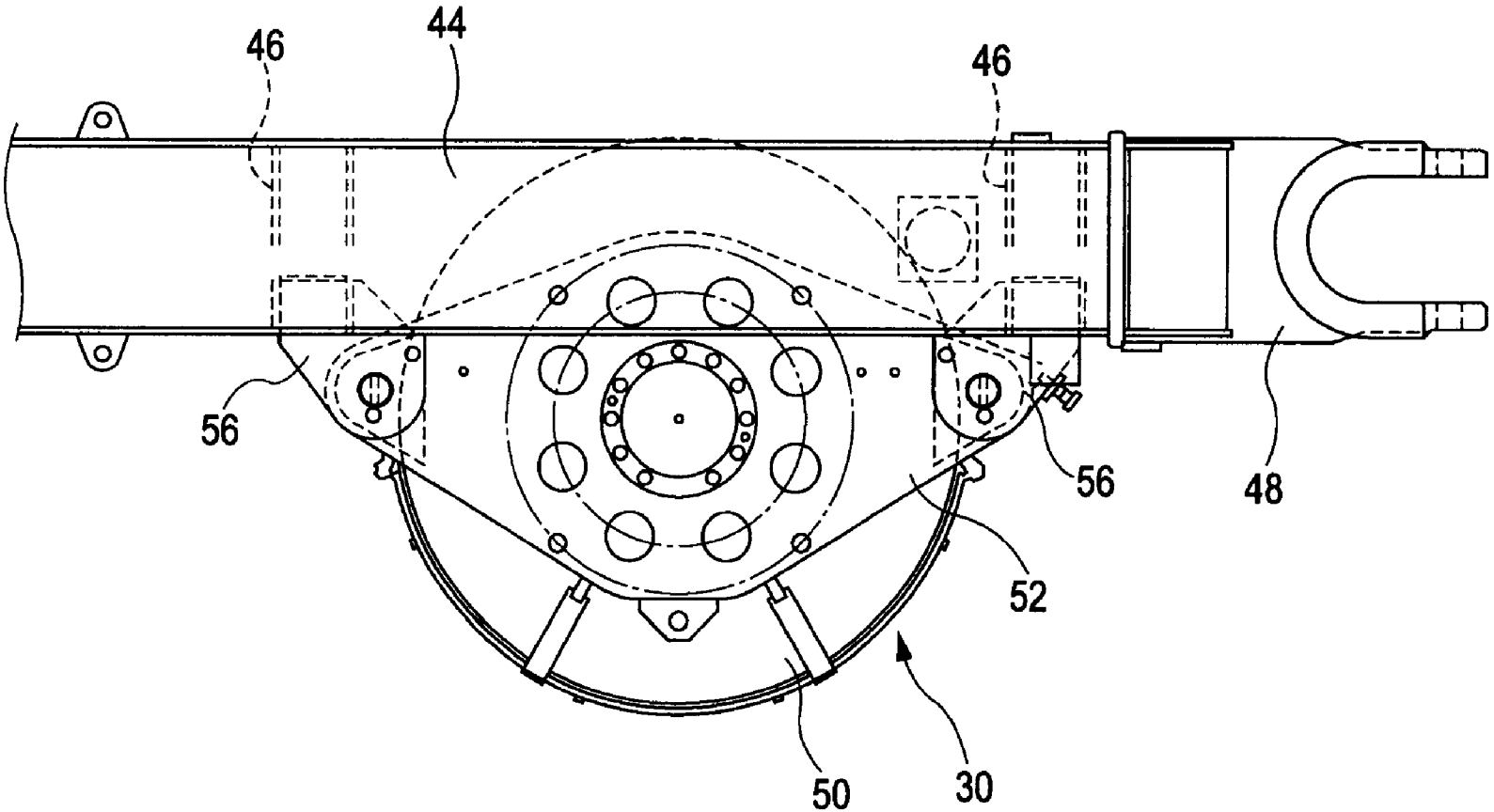
FIG. 2 is a side view showing a boom pivoting winch in the crane and a mounting structure thereof.
Figure 3:
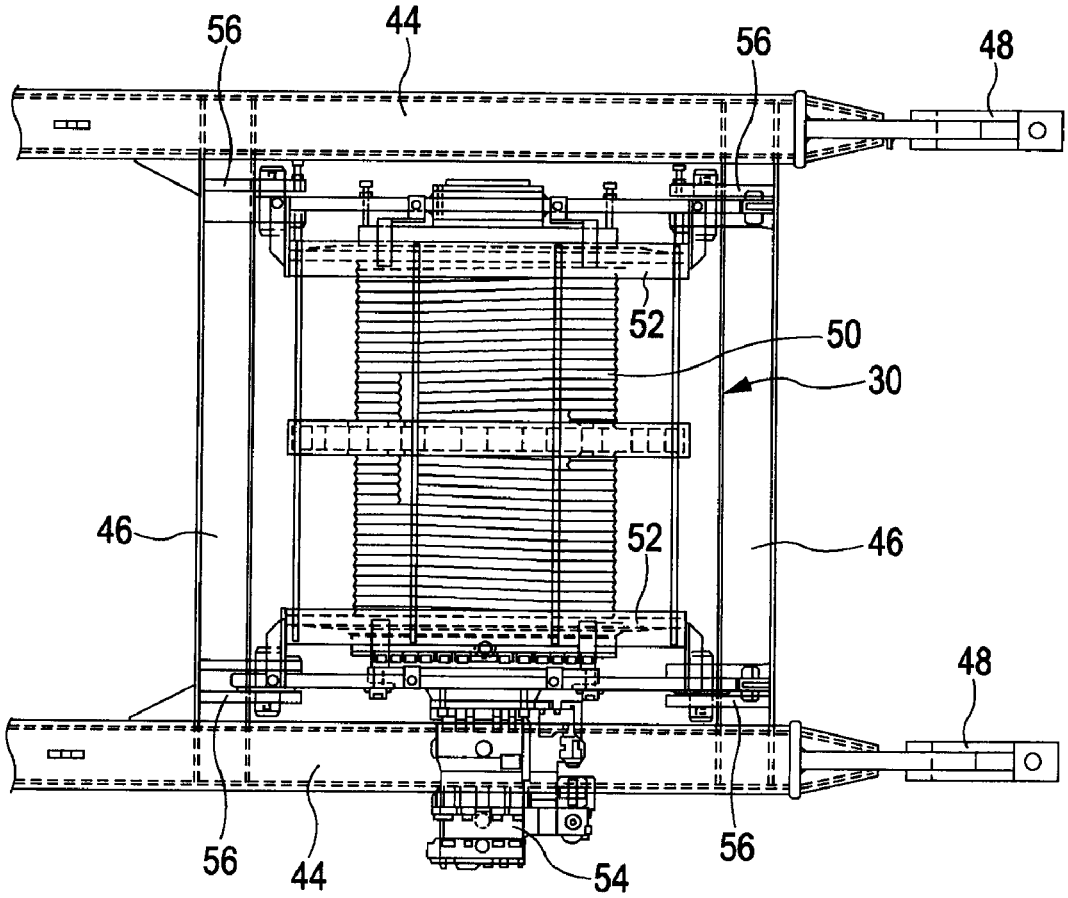
FIG. 3 is a rear view showing the boom pivoting winch in the crane and a mounting structure thereof.

The boom pivoting winch 30 and a mounting structure thereof are shown in FIGS. 2 and 3, respectively.

The mast 20, on which the boom pivoting winch 30 is mounted, includes a left and right pair of main members 44 extending in a longitudinal direction and a plurality of bar members 46 for connecting the main members 44 to each other in a width direction. In the end portion of each of the main members 44, a connecting member 48 is provided to be connected to the swivel body 12 so as to be pivotable, and the bar members 46 are provided intermittently in the longitudinal direction of the mast 20. The boom pivoting winch 30 is disposed between the sheave blocks 40 and in a position between two of the bar members 46 close to the pair of the joint members 48.

The boom pivoting winch 30 includes a winch drum 50 and a main frame for holding the winch drum 50 so as to be rotatable, and the boom pivoting rope 38 is wound around the winch drum 50, to which a winch motor 54 for rotating thereof is connected. The main frame includes flange portions 52 located at left and right sides of the winch drum 50, and the front and rear edges of each of the flange portions 52 are joined to the sheave blocks 42 via brackets 56, respectively.

The jib pivoting winch 32 reels in and reels out the jib pivoting rope 58, whereby the jib pivoting rope 58 is strung so as to allow the front strut 22 to pivot. More specifically, there is provided a guide sheave 60 in a intermediate portion of the rear strut 21 in a longitudinal direction, and are also provided sheave blocks 62 and 64, each of which is composed of a plurality of sheaves disposed in a width direction, on the pivot end portions of the rear strut 21 and front strut 22, respectively. The jib pivoting rope 58 drawn from the jib pivoting winch 32 is looped over the guide sheave 60 and further the sheave blocks 62 and 64. Accordingly, the jib pivoting winch 32 changes the distance between the sheave blocks 62 and 64 by reeling in or reeling out the jib pivoting rope, and thereby pivots the front strut 22 and the jib 18 synchronized therewith in the tilting direction.

The main hoisting winch 34 reels in and reels out a main hoisting rope 66, by which a hanging load is hoisted up and hoisted down. More specifically, main hoisting guide sheaves 67M, 68M and 69M are installed in a portion close to the base end of the rear strut 21, a portion close to the base end of the front strut 22 and the top end portion of the jib 18, respectively so as to be rotatable. Furthermore, there is provided a main hoisting sheave block 70, which is composed of a plurality of sheaves disposed in a width direction, in a position adjacent to the main hoisting guide sheave 69M, and the main hoisting rope 66 drawn from the main hoisting winch 34 is looped over the main hoisting guide sheaves 67M, 68M and 69M, in this order, and further the main hoisting sheave block 70 and a sheave block 74 provided on a main hook 72 for hanging a load. Accordingly, the main hoisting winch 34 changes the distance between the sheave blocks 70 and 74 by reeling in or reeling out the main hoisting rope 66, and thereby allows the main hook 72 to be hoisted up and hoisted down.

Similarly, the auxiliary hoisting winch 36 reels in and reels out an auxiliary hoisting rope 76, and thereby allows a hanging load to be hoisted up and hoisted down. More specifically, auxiliary hoisting guide sheaves 67S, 68S and 69S installed on the same shaft as the main hoisting guide sheaves 67M, 68M and 69M so as to be rotatable. Further, there is provided a point sheave 78 in a position adjacent to the auxiliary hoisting guide sheave 69S so as to be rotatable, and the auxiliary hoisting rope 76 drawn from the auxiliary hoisting winch 36 is looped over the auxiliary hoisting guide sheaves 67S, 68S and 69S, in this order, and is hung down from the point sheave 78. Accordingly, the auxiliary hoisting winch 36 hoists up and hoists down an auxiliary hook for hanging a load (not shown) by reeling in or reeling out the auxiliary hoisting rope 76, the auxiliary hook being connected to the end of the auxiliary hoisting rope 76.

Figure 4:
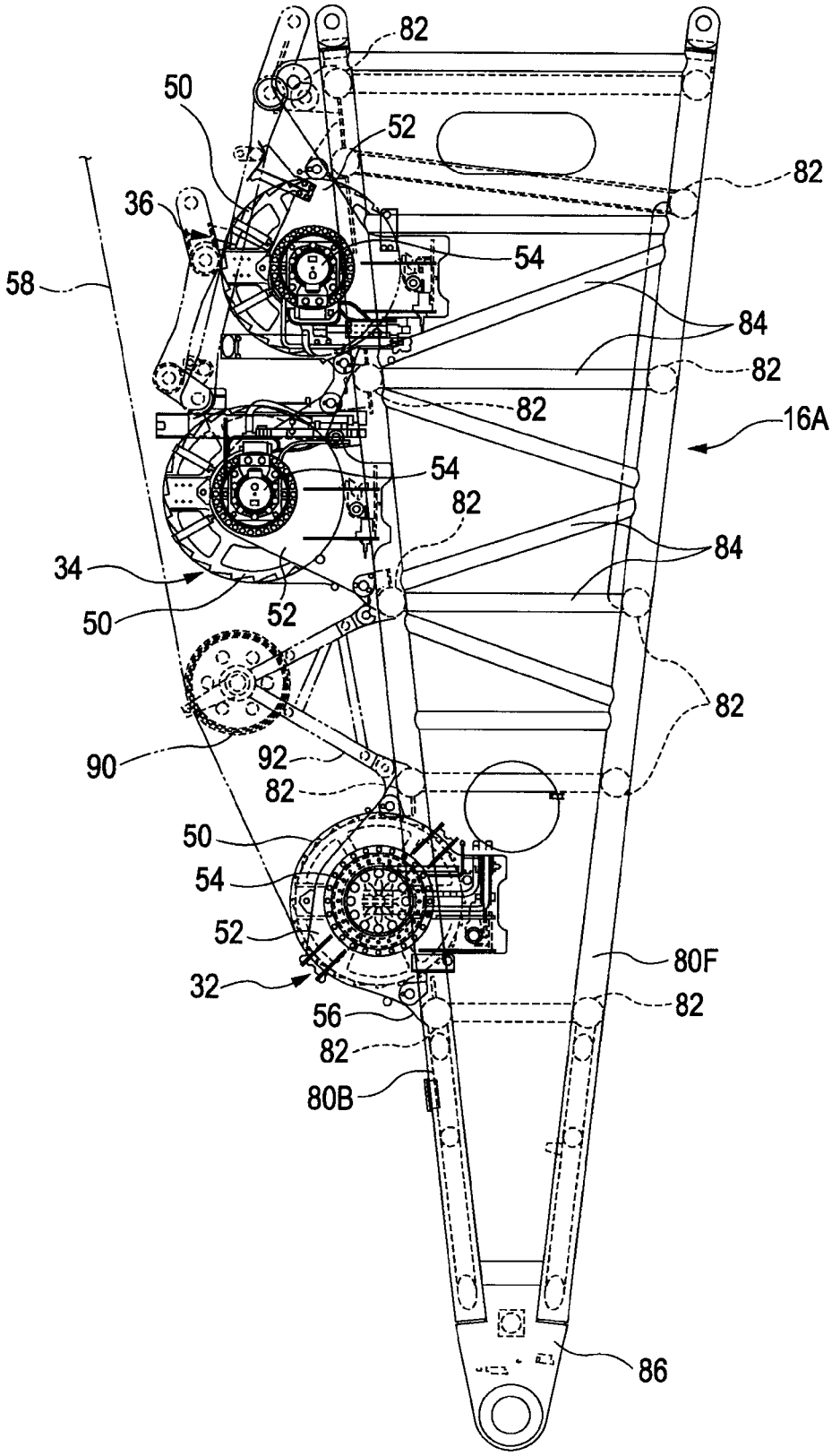
FIG. 4 is a side view showing a jib pivoting winch, main hoisting winch and auxiliary hoisting winch in the crane, and a mounting structure thereof.
Figure 5:
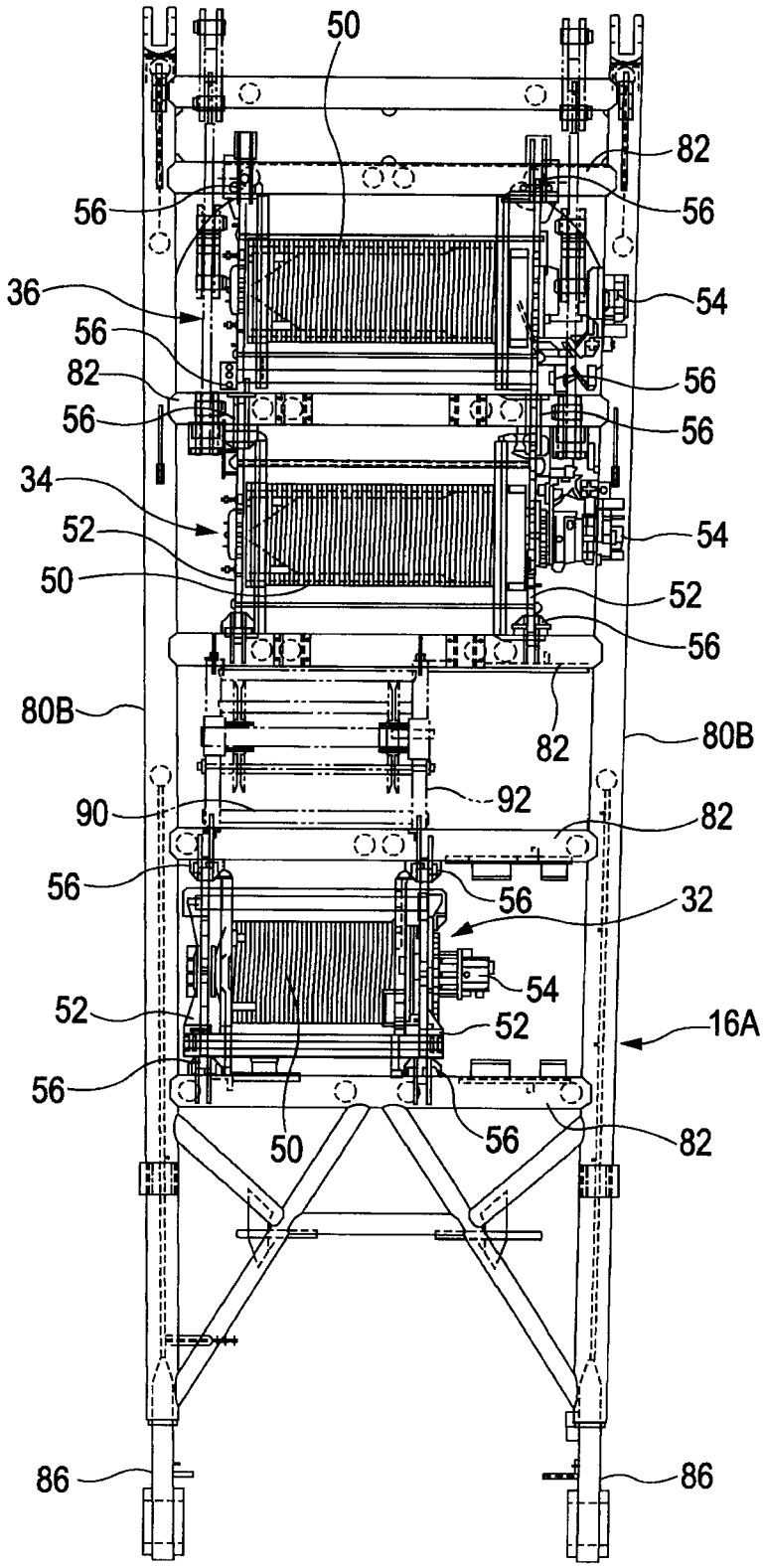
FIG. 5 is a rear view showing the jib pivoting winch, main hoisting winch and auxiliary hoisting winch in the crane, and a mounting structure thereof.

The jib pivoting winch 32, main hoisting winch 34 and auxiliary hoisting winch 36 and a mounting structure thereof are shown in FIGS. 4 and 5, respectively.

The base-end-side member 16A, on which these winches 32, 34 and 36 are installed, includes a left and right pair of abdominal-side main members 80F, a left and right pair of back-side main members 80B, a plurality of bar members 84 that connect the abdominal-side main members 80F and the back-side main members 80B to each other in a boom-width direction, and a plurality of auxiliary members 84 that connect the abdominal-side main members 80F and the back-side main members 80B to each other in a boom-thickness direction. The abdominal-side main members 80F are provided on the abdominal surface, i.e., the tilt down-side surface of the boom 16, and the back-side main members 80B are provided on the back surface, i.e., the tilt up-side surface of the boom 16. The bar members 82 are provided intermittently in the longitudinal direction of the boom 16, whereas the auxiliary members 84 are provided in a lattice pattern.

The abdominal-side main members 80F and back-side main members 80B are disposed so that the spacing between the adjacent members (spacing in a boom-thickness direction) become smaller with increasing proximity to the base end of the base-end-side member 16A. The base ends of the both abdominal-side main member 80F and back-side main member 80B on the left side are connected to one common connecting member 86, and the base ends of the both abdominal-side main member 80F and back-side main member 80B on the right side are also connected to the other common connecting member 86. The connecting members 86 are each configured to be joined to the swivel body so as to be pivotable (to be pin jointed).

As known from the above description, the base-end-side member 16A has a back surface on the tilt-up side of the boom 16 and an abdominal surface on the tilt-down side, and is configured so that the distances between the back and abdominal surfaces become smaller with increasing proximity to the swivel body 12. On the back surface of the base-end-side member 16A, the jib pivoting winch 32, main hoisting winch 34 and auxiliary hoisting winch 36 are disposed in the boom-length direction in an area between the back-side main members 80B, in this order from the base-end-side. More specifically, the jib pivoting winch 32 is disposed between the first and second bar members 82, when counted from the base end side, the main hoisting winch 34 is disposed between the third and fourth bar members 82, and the auxiliary hoisting winch 36 is disposed between the fourth and fifth bar members 82. Each of the winches 32, 34 and 36 includes a winch drum 50 and a main frame for holding the winch drum 50 so as to be rotatable, as with the boom pivoting winch 30. The jib pivoting rope 58, main hoisting rope 66 and auxiliary hoisting rope 76 are wound around the respective winch drums 50, to each of which a winch motor 54 for rotating thereof is connected. The main frame includes flange portions 52 located at left and right sides of the winch drum 50, and the front and rear edges of each of the flange portions 52 are joined to the bar members via brackets 56, respectively.

Additionally, a guide sheave 90 for guiding the jib pivoting rope 58 is provided between the jib pivoting winch 32 and the main hoisting winch 34 (and auxiliary hoisting winch 36). The guide sheave 90 is located in a position such that the distance between the jib pivoting rope 58 and the base-end-side member 16A allows the jib pivoting rope 58 drawn from the jib pivoting winch 32 to be prevented from being interfered with by the main hoisting winch 34 and auxiliary hoisting winch 36. More specifically, a sheave supporting base 92 is disposed between the second and third bar members 82, when counted from the base end side, and the guide sheave 90 is supported by the sheave supporting base 92 so as to be rotatable.

This guide sheave 90 prevents the jib pivoting rope 58 drawn from the jib pivoting winch 32 from being interfered with by the main hoisting winch 34 and auxiliary hoisting winch 36 with certainty, even though the jib pivoting winch is positioned near to the main hoisting winch 34 and auxiliary hoisting winch 36. This enables the above winches 32, 34 and 36 to be arranged in an advantageously compact manner.

Each pair of the backstops 23, 25 and guylines 24, 26, 28 described above is connected to the member concerned on left and right sides thereof, and the winches 30, 32, 34 and 36 are each disposed in the area between the left and right sides on the member concerned, and the ropes 38, 58, 66 and 76 are strung also in the areas; therefore, no interference arises between these components. Furthermore, the guide sheaves 67M and 67S, which guide the main hoisting rope 66 and auxiliary hoisting rope 76 drawn from the main hoisting winch 34 and auxiliary hoisting winch 36, respectively, are located in an area near the base end of the rear strut 21, whereas the guide sheave 60, which guide the jib pivoting rope 58 drawn from the jib pivoting winch 32, is located at an intermediate position in the longitudinal direction of the rear strut 21. Since the guide sheave 60 is positioned further away from the top end of the boom 16 toward the tilt-up side than the guide sheaves 67M and 67S, the main hoisting rope 66 and auxiliary hoisting rope 76 would not intersect with each other.

In the crane 10 described above, a hanging load is hoisted up and hoisted down by the main hoisting rope 66 and auxiliary hoisting rope 76, which are reeled in and reeled out by the main hoisting winch 34 and auxiliary hoisting winch 36, respectively. On the other hand, the mast 20 and the boom 16 synchronized therewith are pivoted in a tilting direction by the boom pivoting rope 38, which is reeled in and reeled out by the boom pivoting winch 30, and the front strut 22 and the jib 18 synchronized therewith are pivoted in a tilting direction by the jib pivoting rope 58, which is reeled in and reeled out by the jib pivoting winch 32.

Additionally, the jib pivoting winch 32, main hoisting winch 34 and auxiliary hoisting winch 36 are mounted on the boom 16, and the boom pivoting winch 30 is mounted on the mast 20; therefore, when the boom 16 and mast 20 are removed from the swivel body 12, the winches 32, 34, 36 and 30 do not remain on the swivel body 12. As a result, transportation costs for the swivel body 12 can be effectively reduced. Furthermore, the disassembling work can be performed without removing ropes strung over the boom 16 therefrom, which facilitates the disassembling work.

The boom 16 is composed of the base-end-side member 16A, intermediate members 16B and 16C and top-end-side member 16D, which can be decoupled with each other. Accordingly, the boom 16 can be disassembled, and the disassembling of the boom 16 contributes to reduce the cost for transporting the boom 16.

Installation of the winches 32, 34 and 36 on the base-end-side member 16A brings about the following effects.

Figure 6:
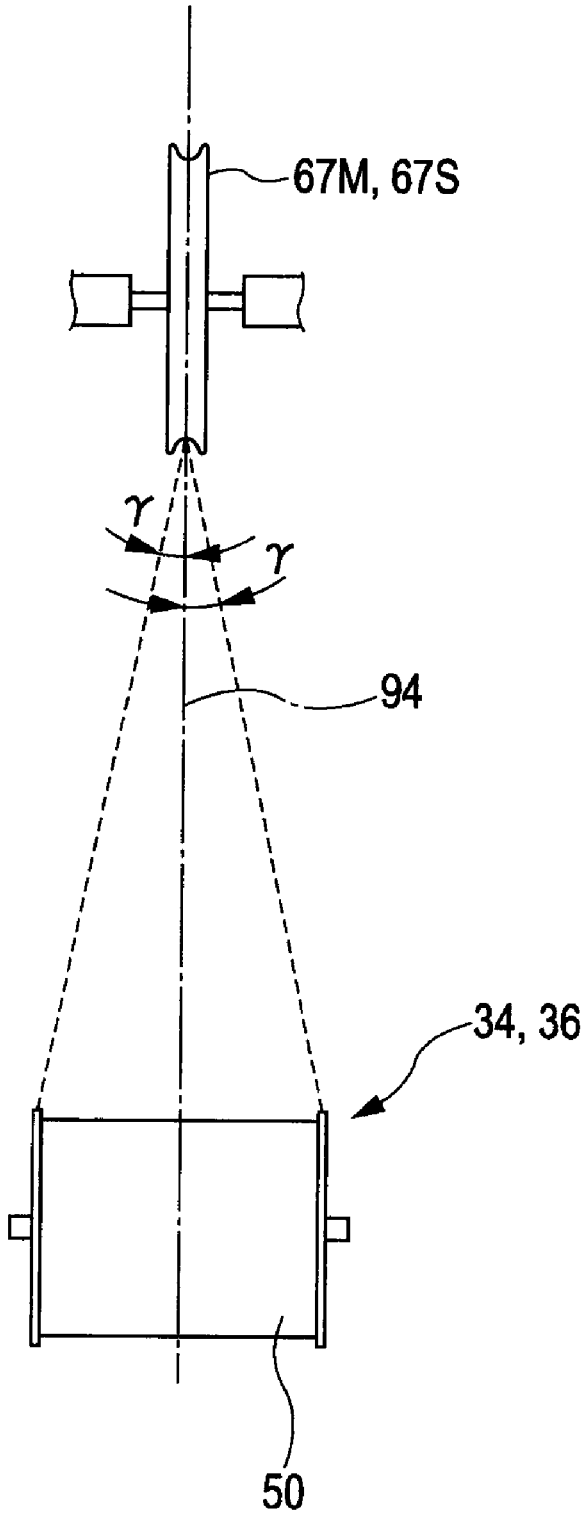
FIG. 6 is an explanatory drawing schematically showing fleet angles of the main hoisting winch and auxiliary hoisting winch in the crane.

(i) Fleet angles γ of the main hoisting rope 66 and auxiliary hoisting rope 76 shown in FIG. 6 become small. The fleet angle γ is the maximum value of angles (so-called a deviation angle) between each of the ropes from the respective sheaves located most close to the main hoisting winch 34 and auxiliary hoisting winch 36 (the guide sheaves 67M and 67S mounted on the rear strut 21 in this embodiment) and a plane 94 that passes through each of the sheaves and crosses the winch drum 50 of each of the main hoisting winch 34 and auxiliary hoisting winch 36 vertically, and becomes smaller as the distance between each of the sheaves and the corresponding winch drum 50 becomes larger. For this reason, installation of the winches 34 and 36 on the base-end-side member 16A allows each of the fleet angles γ to be reduced compared to the case that the winches 34 and 36 are installed on the intermediate members 16B and/or 16C. The reduction in the fleet angles γ is conducive to prevention of wear and damage of the ropes 66 and 76.

(ii) Since the base-end-side member 16A can be clearly recognized to be connected to the swivel body 12, there would be little risk to assemble it in wrong order. Accordingly, the installation of the above winches on this base-end-side member 16A ensures that they are disposed at predetermined positions in the crane 10. In the case of a crane that includes a plurality of intermediate members having the same shape with each other, there is a merit that the intermediate members are interchangeable with each other and are irrespective of the assembling order thereof; however, if some of the intermediate members are provided with the above winches, the interchangeability of the intermediate members is lost. Conversely, the base-end-side member 16A is only the boom member connected to the swivel body 12, so the installation of the above winches on the base-end-side member 16A does not cause such the inconvenience.

(iii) Since the base-end-side member 16A is positioned in the location most close to the swivel body 12, the installation of the main hoisting winch 34 and auxiliary hoisting winch 36 on the base-end-side member 16A brings about another advantage that the length of power transmission members (hydraulic piping when the winches are hydraulic ones, or electric wiring when the winches are electric ones) connecting the winches 34 and 36 to the power source mounted on the swivel body 12 becomes short. Furthermore, disconnection of the power transmission members (for example, disassembly of the hydraulic piping or disconnection of connectors used for the electric wiring) becomes unnecessary.

(iv) In the case of a crane, as in this case, that the base-end-side member 16A has a back surface on the tilt-up side of the tilt members and an abdominal surface on the tilt-down side of the tilt members, and is configured so that the distances between the back and abdominal surfaces become smaller with increasing proximity to the crane body of this crane, the winches 34 and 36 are installed in a portion, where the distance between the back and abdominal surfaces is smaller than other portions; whereby, the outside shape of the whole boom 16 including the winches 34 and 36 can be made compact.

It should be noted that the jib 18 and jib pivoting winch 32 of a crane according to the present invention may be omitted, and, for example, the tilt member of the crane may be composed of the boom 16 only. Furthermore, the boom 16 is not necessarily limited to such a disassembleable type described above, but may be of a type that is composed of a single member. In the case of a crane equipped with the jib 18, a specific measure for pivoting the jib 18 is also not necessarily limited to that shown in FIG. 1, but may be of, for example, a gantry type or a similar type.

Figure 7:
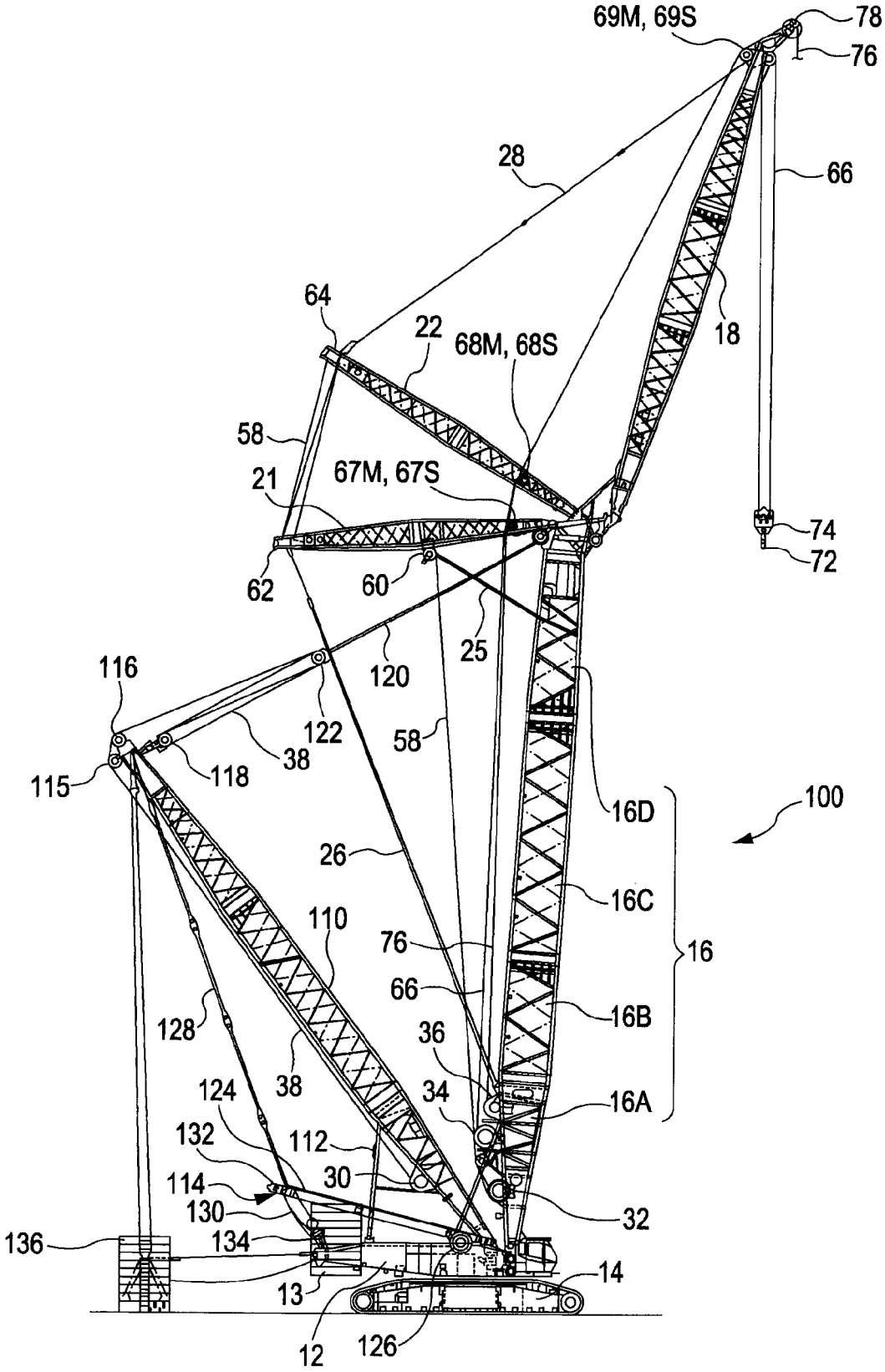
FIG. 7 is an overall side view of a crane according to a second embodiment of the present invention.

FIG. 7 shows a crane 100 according to a second embodiment of the present invention, the crane 100 having members different from the mast 20 shown in FIG. 1. Some components of the crane 10 according to a first embodiment are also used for the crane 100 according to a second embodiment, and the same reference numerals are given to the common components and the explanation thereof will be omitted.

In the crane 100, a mast 110 is equipped as a boom pivoting member, the mast 110 being used as a rope supporting member. The boom pivoting rope 38 is strung between the mast 110 and boom 16 so as to pivot the boom 16 by being reeled in and reeled out by the boom pivoting winch 30, which is the same winch as included in the crane according to the first embodiment.

The mast 110 is connected to the swivel body 12 at a position behind the boom 16 so as to be pivotable in the same direction as the tilting direction of the boom 16.

Furthermore, the crane 100 includes a backstop 112 and a mast pivoting member 114 as components for holding the position of the mast 110. The backstop 112 is provided on the swivel body 12 so as to be in contact with the mast 110 in a vertical position and supports the mast 110 from the back side thereof at a predetermined angle as shown in the attached figure.

The boom pivoting winch 30 is provided on the back surface of the base end portion of the mast 100 in the same structure as that shown in FIGS. 2 and 3. The boom pivoting rope 38 drawn from the boom pivoting winch 30 is looped over the top end portion (pivot end portion) of the mast 110 and the top end portion of the boom 16.

More specifically, there are provided a sheave block 118, which is composed of a plurality of sheaves disposed in a width direction, on the top end portion of the mast 110, as well as being provided with guide sheaves 115 and 116. On the other hand, one end of a boom guiding line 120 is connected to the top end of a top-end-side member 16D of the boom 16, and the other end of the boom guiding line 120 is connected to a sheave block 122. The boom pivoting rope 38 drawn from the boom pivoting winch 30 is looped over the guide sheaves 115 and 116, and is then strung between the sheave blocks 118 and 122.

Accordingly, the boom pivoting winch 30 changes the distance between the both sheave blocks 118 and 122 by reeling in or reeling out the boom pivoting rope 38, and thereby pivots the boom 16 toward a tilting direction.

The mast pivoting member 114 includes an auxiliary mast 124, mast pivoting winch 126 and auxiliary guyline 128.

The auxiliary mast 124, which is configured in the same manner as the mast 20 included in the crane according to the first embodiment, is connected to the swivel body 12 so as to be pivotable in the same direction as the pivoting direction of the mast 110. Furthermore, the top end portion of the auxiliary mast 124 is connected to the top end portion of the mast 110 via a left and right pair of auxiliary guylines 128 so that the auxiliary mast 124 and mast 110 pivot in synchronization with each other.

The mast pivoting winch 126, which is a member for pivoting the auxiliary mast 124 and also the mast 110 in the above tilting direction, is mounted on the back surface of a base end portion of the auxiliary mast 124 in the same structure as that shown in FIGS. 2 and 3.

This mast pivoting winch 126 reels in and reels out a mast pivoting rope 130, whereby the mast pivoting rope 130 is strung so as to allow the auxiliary mast 124 to pivot. More specifically, there are provided sheave blocks 132 and 134, each of which is composed of a plurality of sheaves disposed in a width direction, on the pivot end portion of the auxiliary mast 124 and the rear end portion of the swivel body 12, respectively, the mast pivoting rope 130 drawn from the mast pivoting winch 126 is looped over the sheave blocks 132 and 134. Accordingly, the mast pivoting winch 126 changes the distance between the sheave blocks 132 and 134 by reeling in or reeling out the mast pivoting rope 130, and thereby pivots the auxiliary mast 124 and the mast 110 synchronized therewith toward a tilting direction.

It is noted that although a counterweight 136 for retarding the pivoting motion of the mast 110 toward a tilt-up direction is connected to the top end portion of the mast 110 in this embodiment, the counterweight 136 may be appropriately omitted.

Also when the crane 100 is disassembled, the winches 30, 32, 34, 36 and 126 mounted on the crane 100 are removed from the swivel body 12 together with the boom 16, mast 110 and auxiliary mast 124, and no winch is remaining on the swivel body 12. Consequently, the weight of the swivel body 12 after the crane 100 is disassembled is effectively reduced also in the crane 100 according to this second embodiment.

It should be noted that the "rope supporting member" is not necessarily limited to one like the mast 110, which is connected to the swivel body 12 so as to be pivotable, but may be, for example, one such as an ordinary gantry which fixed on a crane body like the swivel body 12.

Although the invention has been described with reference to the preferred embodiments in the attached figures, it is noted that equivalents may be employed and substitutions made herein without departing from the scope of the invention as recited in the claims.

What is claimed is:

1. A crane, comprising:

a crane body;

a boom connected to the crane body so as to be pivotable;

a plurality of tilt members including the boom, the tilt members pivoting as a whole in accordance with pivoting of the boom;

a main hoisting rope and an auxiliary hoisting rope for each hoisting a hanging load, the main and auxiliary hoisting ropes being each hung from an end portion of one of the tilt members;

a main hoisting winch for reeling in and reeling out the main hoisting rope;

an auxiliary hoisting winch for reeling in and reeling out the auxiliary hoisting rope;

a boom pivoting member connected to the crane body;

a boom pivoting rope strung in an area between the boom pivoting member and the crane body or between the boom pivoting member and the boom; and a boom pivoting winch for reeling in and reeling out the boom pivoting rope to pivot the tilt members, wherein both the main and auxiliary hoisting winches are mounted on the boom, and the boom pivoting winch is mounted on the boom pivoting member, wherein, in addition to the boom, the tilt members include a jib which is connected to a top end portion of the boom so as to be pivotable in a direction with respect to the boom, and are provided with a jib pivoting rope for pivoting the jib and a jib pivoting winch for pivoting the jib by reeling in and reeling out the jib pivoting rope, the jib pivoting winch being mounted on the boom.

2. The crane according to claim 1, wherein the boom includes a base-end-side member connected to the crane body, at least one of intermediate members connected to the top end of the base-end-side member so as to be detachable, and a top-end-side member connected to the top end of the topmost one of the intermediate members so as to be detachable, and is provided with sheaves for guiding the main and auxiliary hoisting ropes, respectively, on the top-end-side member or on another tilt member above the top-end-side member, and also with the main and auxiliary hoisting winches on the base-end-side member.

3. The crane according to claim 2, wherein the base-end-side member has a back surface provided on the tilt-up side of the tilt members and an abdominal surface on the tilt-down side of the tilt members, has a shape such that the distance between the back surface and the abdominal surface becomes smaller with increasing proximity to the crane body, and is provided with the main and auxiliary hoisting winches on the back surface.

4. The crane according to claim 1, further comprising:

first and second jib pivoting members each connected to a top end portion of the boom so as to jut out therefrom toward the tilt-up direction of the boom, wherein the jib pivoting rope drawn from the jib pivoting winch via the first jib pivoting member is strung between the second jib pivoting member and the jib, the jib pivoting winch being mounted on the boom at a position closer to the crane body than the main and auxiliary hoisting winches.

5. The crane according to claim 4, further comprising: a guide sheave for guiding the jib pivoting rope, wherein the guide sheave is disposed between the jib pivoting winch and the main and auxiliary hoisting winches so that the jib pivoting rope drawn from the jib pivoting winch is not interfered with by the respective main and auxiliary hoisting winches.

6. The crane according to claim 1, wherein the boom pivoting member includes a mast connected to the crane body so as to be pivotable in the same direction as the tilting direction of the boom, the mast being also connected to the boom so that the boom pivots in synchronization with the mast, and the boom pivoting rope is strung between the mast and the crane body so that the mast is pivoted as the boom pivoting rope is reeled in or reeled out by the boom pivoting winch.

7. The crane according to claim 1, wherein the boom pivoting member includes a rope supporting member connected to the crane body so as to be held in a specified position, and the boom pivoting rope is strung between the rope supporting member and the boom so that the boom is pivoted as the boom pivoting rope is reeled in or reeled out by the boom pivoting winch.

8. The crane according to claim 7, wherein the rope supporting member is a mast connected to the crane body so as to be pivotable in the same direction as the tilting direction of the boom, and is provided with a backstop for supporting the mast from the back side thereof at a predetermined angle and is also provided with mast pivoting means for pivoting the mast so as to allow the mast to be pushed to and held at the backstop in the angled position, the mast pivoting means being connected to the crane body so as to be pivotable in the same direction as the pivoting direction of the mast and having an auxiliary mast connected to the mast so that the specified pivoting portion pivots in synchronization with the mast and a mast pivoting winch for pivoting the auxiliary mast, the mast pivoting winch being mounted on the auxiliary mast.

9. A crane comprising:

a crane body;

a boom including a base-end-side member pivotably connected to the crane body and at least one intermediate member detachably connected to a top end of the base-end-side member, wherein a width of the base-end-side member becomes smaller in a direction of pivoting of the boom with increasing proximity to the crane body;

at least first and second winches provided to the base-end-side member, wherein one of the first and second winches is provided to the base-end-side member at a position closer to the crane body than the other of the first and second winches, and wherein the other of the first and second winches is provided to the base-end-side member at a position farther from the crane body than the one of the first and second winches;

a plurality of tilt members including the boom, the tilt members pivoting as a whole in accordance with pivoting of the boom;

first and second ropes respectively extending from the first and second winches and toward the tilt members;

a guide sheave provided to the base-end-side member at a position between the first and second winches, wherein the first rope is guided by the guide sheave, and wherein the guide sheave is positioned such that the second winch does not interfere with the first rope;

a boom pivoting member connected to the crane body;

a boom pivoting rope strung in an area between the boom pivoting member and the crane body or between the boom pivoting member and the boom; and a boom pivoting winch mounted on the boom pivoting member for reeling in and reeling out the boom pivoting rope to pivot the tilt members.

10. A crane comprising:

a crane body;

a boom including a base-end-side member pivotably connected to the crane body and at least one intermediate member detachably connected to a top end of the base-end-side member, wherein a width of the base-end-side member becomes smaller in a direction of pivoting of the boom with increasing proximity to the crane body;

at least first and second winches provided to the base-end-side member, wherein one of the first and second winches is provided to the base-end-side member at a position closer to the crane body than the other of the first and second winches, and wherein the other of the first and second winches is provided to the base-end-side member at a position farther from the crane body than the one of the first and second winches;

first and second ropes respectively extending from the first and second winches and toward a top end of the boom;

a guide sheave provided to the base-end-side member at a position between the first and second winches, wherein the first rope is guided by the guide sheave, and wherein the guide sheave is positioned such that the second winch does not interfere with the first rope.

* * * * *